United States Patent [19]

Wegner et al.

[11] Patent Number: 4,659,335

[45] Date of Patent: Apr. 21, 1987

[54] IGNITION IMPROVERS FOR FUEL MIXTURES

[75] Inventors: Christian Wegner; Helmut Waniczek, both of Cologne, Fed. Rep. of Germany

[73] Assignee: Bayer Aktiengesellschaft, Leverkusen, Fed. Rep. of Germany

[21] Appl. No.: 715,566

[22] Filed: Mar. 25, 1985

[30] Foreign Application Priority Data

Mar. 31, 1984 [DE] Fed. Rep. of Germany ..... 3412078

[51] Int. Cl.[4] ..... C10L 1/02

[52] U.S. Cl. ..... 44/53; 44/57; 44/72; 44/76; 44/77; 123/1 A; 123/198 A

[58] Field of Search ..... 44/53, 57, 58, 7 B, 44/63, 62, 76, 72, 77; 123/1 A, 198 A; 536/17.7, 30

[56] References Cited

U.S. PATENT DOCUMENTS

| | | | |
|---|---|---|---|
| 1,995,911 | 3/1935 | Wysocki et al. | 44/7.4 |
| 2,001,070 | 5/1935 | Shankweiler et al. | 44/7.3 |
| 2,046,101 | 6/1936 | York | 44/7.4 |
| 2,965,678 | 12/1960 | Sundberg et al. | 44/77 |
| 3,672,851 | 6/1972 | Ihm | 44/7.4 |
| 4,298,352 | 11/1981 | Blysing | 44/72 |
| 4,332,594 | 6/1982 | Zimmerman | 44/77 |
| 4,465,028 | 8/1984 | Waniczek et al. | 44/57 |

FOREIGN PATENT DOCUMENTS

| | | | |
|---|---|---|---|
| 0071134 | 2/1983 | European Pat. Off. | 44/53 |
| 2909565 | 9/1980 | Fed. Rep. of Germany . | |
| 0422598 | 1/1935 | United Kingdom | 44/72 |

OTHER PUBLICATIONS

*The Merck Index,* Windholz, 10th Ed., Merck & Co., Inc., Rahway, N.J., 1983, p. 7914.
Abstract, 2039609, Germany.
Abstract, 2701,588, Germany.
Abstract, 2909,565, Germany.

*Primary Examiner*—William R. Dixon, Jr.
*Assistant Examiner*—Margaret B. Medley
*Attorney, Agent, or Firm*—Sprung, Horn, Kramer & Woods

[57] ABSTRACT

Mixtures of nitrocellulose and polyether are used as ignition improvers for alcoholic propellants.

19 Claims, No Drawings

IGNITION IMPROVERS FOR FUEL MIXTURES

The invention is concerned with ignition improvers for alcoholic propellants and alcoholic fuel mixtures which can be employed for the operation of diesel engines.

Methanol and ethanol cannot be employed in place of mineral hydrocarbons in diesel engines of customary design since the cetane numbers of ethanol and methanol are only 8 and 3 respectively. However, for trouble-free operation, diesel engines require a propellant with a cetane number of at least 45 (DIN 51,601; Winnacker-Küchler, Chemische Technologie [Chemical technology], Volume 3/I, 326 (1971)).

Ignition improvers are therefore required to increase the cetane number. For propellants based on methanol and ethanol, alkyl nitrates and cycloalkyl nitrates are known (German Offenlegungsschrift No. 2,701,588, German Offenlegungsschrift No. 2,039,609, Mineralogie Technik 80, 25 (4), 1 to 12), the preparation of which however is complicated and which can hydrolyse in the presence of water. By this process nitric acid is formed which destroys the engines by corrosion. Nitric acid salts of primary, secondary and tertiary amines such as for example mono-, di- and triethylammonium nitrate are also known as ignition improvers for methanol and ethanol (German Offenlegungsschrift No. 2,909,565), but they also show corrosive properties.

Ignition improvers for alcoholic propellants are known from European Pat. No. A 0,071,134, which contain nitric acid esters of mono- and/or polysaccharides, for example nitrocellulose. However on using these ignition improvers in those parts of the engines which conduct the fuel, nitrocellulose films form on the walls, which can lead to solid residues with a blocking effect. This disadvantage cannot be overcome satisfactorily by the addition of further solvents.

Moreover, problems arise in the use of alcohol-based propellants with the ignition improvers disclosed in European Pat. No. A 0,071,134, if they come into contact with conventional mineral oil-based propellants. As a consequence of the poorer solubility of these ignition improvers in mineral oil, precipitation of the ignition improver occurs which also leads to blockage of the engine.

However, for practical use the compatibility of propellants based on mineral oil and on alcohol is especially important.

For internal combustion engines, ignition improvers for alcoholic propellants have been found which contain nitrocellulose with a nitrogen content of 9 to 14% and polyether with at least three ethylene oxide units.

When used in engines, the ignition improvers according to the invention leave no residues which lead to blockages. They are completely compatible with mineral oil-based propellants.

Nitrocellulose with a nitrogen content of 9 to 14%, preferably from 10 to 13%, can be used for the ignition improvers according to the invention.

Nitrocelluloses which increase the viscosity of the alcoholic propellant as little as possible are particularly preferred. Therefore, according to the invention, it is particularly advantageous to employ nitrocelluloses with an intrinsic viscosity k of less than 1000, preferably from 800 to 200. The intrinsic viscosity of the nitrocellulose can be determined in a manner known per se (Fikentscher, Cellulosechemie 13, 58 (1932)).

The preparation of the nitrocellulose for the ignition improvers according to the invention is known per se (K. Fabel, Nitrocellulose-Herstellung und Eigenschaften [Nitrocellulose-Preparation and Properties], Enke Verlag, Stuttgart (1950)). It can for example be prepared by reacting it in a homogeneous and/or heterogeneous phase with nitric acid or its anhydride in the presence of hygroscopic agents such as sulphuric acid, phosphoric acid, phosphorus pentoxide or acetic anhydride. The degree of nitration can be controlled ad libitum by the amount and concentration of the nitric acid or of the dehydrating additives.

Polyethers with at least three ethylene oxide units, preferably 4 to 100 ethylene oxide units, are employed for the ignition improvers according to the invention. According to the invention polyethers are preferred which are prepared by reaction of compounds which have at least one OH and/or NH group, with ethylene oxide in a manner known per se. It is of course possible and, where appropriate, also technically advantageous to employ polyethers with various degrees of ethoxylation and with various OH and NH compounds. The polyethers can also contain, apart from the ethylene oxide units according to the invention, further alkylene oxide units, preferably 0.1 to 0.5 propylene oxide units, based on an ethylene oxide unit.

Preferred compounds, having an OH group, which may be mentioned are compounds of the formula $$R^1—OH$$

in which $R^1$ denotes hydrogen or alkyl, which is optionally substituted by hydroxyl or amino.

Preferred compounds, having an NH group, which may be mentioned are compounds of the formula

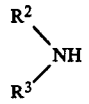

in which $R^2$ and $R^3$ are identical or different and denote hydrogen or alkyl, which is optionally substituted by hydroxyl or amino.

In this case alkyl represents in general a linear or branched hydrocarbon radical with 1 to 6 carbon atoms. Examples which may be mentioned are the following alkyl radicals: methyl, ethyl, propyl, isopropyl, butyl, isobutyl, pentyl, isopentyl, hexyl and isohexyl.

If the compounds with at least one OH or NH group are substituted by further hydroxyamino groups, compounds with 1 to 5, preferably 1 or 2, hydroxyl and/or amino groups are preferred.

Examples of compounds with an OH and/or NH group are water, mono- and polyols such as methanol, ethanol, propanol, butanol, amylalcohol, ethylene glycol, propylene glycol, glycerol, trimethylolpropane and pentaerythritol, and nitrogen-containing compounds such as ammonia, ethanolamine, triethanolamine and dimethylethanolamine. Mixtures of these compounds are also applicable as initiator molecules for the ethylene oxide addition. As initiators, water and low molecular weight mono- and polyols are particularly preferred.

The concentrates contain, in general, 15 to 60 parts by weight of nitrocellulose and 20 to 70 parts by weight of polyether. The ignition improvers according to the invention preferably contain 20 to 50 parts by weight of nitrocellulose and 30 to 60 parts by weight of polyether.

The ignition improvers according to the invention can of course contain in addition other additives, which are known per se. In particular, mention should be made here of the joint use of further ignition improvers, which are known per se, as well as of the addition of components which are suitable for combustion in a diesel engine such as for example propylene oxide polyethers, fatty alcohols, fatty acid esters, diesel oil and vegetable oils such as soya oil, castor oil, or tall oil. The addition of detergents and initiation aids is likewise possible.

The propellants which contain the ignition improvers according to the invention can be prepared directly from the individual components, that is from nitrocellulose, polyether and alcohol. However, the preparation of a concentrate consisting of these components is preferred, which is then to be diluted with alcohol until the concentration of the ignition improver according to the invention ensures the satisfactory running ability of an engine. The ignition improvers according to the invention can be used as an additive for alcoholic fuels.

The present invention also relates to fuel mixtures which contain alcohol and an ignition improver, which contains nitrocellulose with a nitrogen content of 9 to 14% and a polyether with at least three ethylene oxide units. The fuel mixtures according to the invention are suitable for the operation of diesel engines, particularly vehicle diesel engines and such engines as make similar demands on the fuel.

According to the invention, alcohol is a low molecular weight aliphatic alcohol with 1 to 6 carbon atoms. Methanol and/or ethanol are particularly preferred here. Where appropriate, the alcohols can contain up to 10% by weight of water. Thus, for example, ethanol which is obtained by fermentation and which thereby occurs as an azeotrope with 4.5% of water, can be used.

The concentration of the nitrocellulose in the propellant mixtures according to the invention is dependent on the cetane number which is to be attained. For satisfactory operation in a conventional diesel engine concentrations of 2 to 12% by weight, preferably 4 to 8% by weight, are preferred.

The concentration of the polyether in the fuel mixtures according to the invention is based on the concentration of the nitrocellulose, its k-value and the desired consistency of the residue after volatilization of the alcohol. In the fuel mixtures according to the invention the ratio of nitrocellulose to polyether should be from 1:0.2 to 1:2.0. It is preferably 1:0.5 to 1:1.5, especially preferably 1:0.8 to 1:1.2.

In general 3 to 20 parts by weight, preferably 6 to 15 parts by weight, of the ignition improver according to the invention based on the alcohol, are employed.

The use of polyethers with at least three ethylene oxide units is especially advantageous, since these products also serve simultaneously as desensitizing agents for the nitrocellulose. Thus the nitrocellulose can be mixed with the polyethers immediately after the preparation and it is consequently impossible for detonations or explosions to occur during the transport of the nitrocellulose which is to be employed as the ignition improver or after evaporation of the alcohol component. A further advantageous aspect of the joint use of ethylene oxide polyethers is their lubricating effect, which is especially important since low molecular weight alcohols in contrast to conventional diesel oil do not possess any self-lubricating effect.

It is especially surprising that only ethylene oxide polyethers with at least three ethylene oxide units can be advantageously employed in ignition improvers since low molecular weight homologues of this compound class which are likewise involatile at room temperature, such as for example ethylene glycol or diethylene glycol, are not suitable if they are similarly applied. It is also a surprising fact that the propylene oxide polyethers, which are structurally closely related to the ethylene oxide polyethers, do not suppress the tendency to the formation of films, when equivalent weights are employed, even when they have three or more propylene oxide units. Even the plasticizers which are used for the nitrocelluloses in the paints field, such as for example phthalic acid esters of butanol and of 2-ethylhexanol, likewise have a poor efficacy.

EXAMPLE 1

Preparation of an ethanol-based propellant mixture

Procedure A—direct preparation 8 parts of a commercially available nitrocellulose (nitrogen content between 10.0 and 11.5, k-value=400) and 12.5 parts of a mixture of homologues of an ethylene oxide polyether, which was initiated with water, with 4 to 13 ethylene oxide units are stirred for 15 minutes at room temperature with 80 parts of 96% strength ethanol. A clear colourless solution is obtained.

Procedure B—preparation of a concentrate 24 parts of the nitrocellulose and 37.5 parts of the polyether from procedure A are stirred with 38 parts of 96% strength ethanol until a clear, yellowish solution is obtained. The concentrate has a viscosity of 4000 cp at 25° C. In order to obtain the mixture described in procedure A, one part of the concentrate must be diluted with two parts of ethanol. A concentrate, which must be diluted with three parts of ethanol, in order to attain the mixture of procedure A, is prepared from 32 parts of nitrocellulose, 50 parts of polyether and 18 parts of ethanol. It has a viscosity of 60,000 cp at 25° C.

EXAMPLE 2

Preparation of a methanol-based propellant mixture 8 parts of a commercially available nitrocellulose (nitrogen content between 10.0 and 11.5%, k-value 450) are stirred at room temperature for 15 minutes with 12 parts of an ethylene oxide polyether which was initiated with trimethylolpropane and which has a molecular weight of 700, and 80 parts of methanol. A clear colourless solution is obtained.

EXAMPLE 3

Testing of the formation of residues

An alcoholic solution, in which the ratio of the nitrocellulose used in Example 1 to the adjuvant employed is 1:1.5, is spread on a glass plate. The alcohol is allowed to evaporate completely and the consistency of the residue is tested.

| Adjuvant | Consistency of the residue |
|---|---|
| According to the invention: | |
| Linear ethylene oxide polyether with 4–13 ethylene oxide units | Clear, colourless, viscous residue |

-continued

| Adjuvant | Consistency of the residue |
|---|---|
| Trifunctional ethylene oxide polyether (MW = 1200) | Clear, colourless, viscous residue |
| Comparison: | |
| Diethylene glycol | Clear, elastic, slightly adhesive film |
| Ethylene glycol | Clear, elastic, slightly adhesive film |
| Tripropylene glycol | Clear, soft, adhesive film |
| Linear propylene oxide polyether, (MW 1000, OH-number 112) | Clear, soft, non-adhesive film |
| Linear propylene oxide polyether (MW 2000, OH-number 56) | Clear, soft, non-adhesive film |
| Branched propylene oxide polyether (OH-number 250, MW 700) | Clear, soft, non-adhesive film |
| Diethylene glycol diethyl ether | Clear, soft, non-adhesive film |
| Dioctyl phthalate | Cloudy, firm, flaky residue |
| Castor oil | Clear, soft, slightly adhesive film |

The examples show that only on use of the ethylene oxide polyethers with at least three ethylene oxide units, to be employed according to the invention, do the residues which remain have the character of a highly viscous liquid with in some cases an additional lubricating effect. When employed on an equivalent weight basis, all other substances produce residues which, after volatilization of the propellant, would cause faults in moving parts, for example in the injection pump.

EXAMPLE 4

Checking of the running ability of a propellant mixture based on 96% strength ethanol The propellant mixture described in Example 1 is employed in a diesel engine with direct injection, the 1.4-fold quantity being injected, corresponding to the lower calorific value of the mixture with respect to conventional diesel oil. A good running ability of the diesel engine is obtained, with an ignition delay identical to that of the conventional diesel oil. In addition, the running ability of the engine is even obtained if the concentration of the nitrocellulose is reduced to 6%.

EXAMPLE 5

Checking of the running ability of a methanol-based propellant mixture

The propellant mixture described in Example 2 is employed in a prechamber diesel engine, twice the amount of propellant being injected, corresponding to the lower calorific value of the mixture. A good running ability of the diesel engine is obtained, with an ignition delay identical to that of the conventional diesel oil. In addition, the running ability of the engine is even obtained if the concentration of the nitrocellulose is reduced to 5%.

EXAMPLE 6

Checking of the running ability of a methanol-based propellant mixture

A propellant mixture consisting of 6 parts of a nitrocellulose with a k-value of 460, 6 parts of a mixture of homologues of an ethylene oxide polyether, initiated with water, with 8 ethylene oxide units on average, and 88 parts of methanol is employed in a direct-injecting diesel engine, twice the amount of propellant being employed in comparison to mineral oil-based diesel fuel, corresponding to the lower calorific value of the mixture. A good running ability is obtained over the whole speed range, the ignition delay of the mixture according to the invention being identical to that of a conventional diesel oil with a cetane number of 51.

EXAMPLE 7

Compatibility of a propellant mixture with conventional diesel oil

Equals parts of the propellant mixture described in Example 1 and of conventional diesel oil are converted into an emulsion under the action of shear forces. Within 1 hour the emulsion separates, with formation of the initial phases. Cloudiness or precipitation are not observed.

What is claimed is:

1. An ignition improver for an alcoholic propellant for an internal composition engine which comprises nitrocellulose with a nitrogen content of 9 to 14% by weight and an intrinsic viscosity k of less than 1000 and a polyether with at least three ethylene oxide units; the ratio of nitrocellulose to polyether being from 1:0.2 to 1:2.0 and wherein the concentration of the nitrocellulose in the propellant mixture is 2 to 12% by weight.

2. An ignition improver according to claim 1 wherein said nitrocellulose has an intrinsic viscosity in the range from 200 to 800.

3. An ignition improver according to claim 1 wherein said polyether has 4 to 100 ethylene oxide units.

4. An ignition improver according to claim 1 in the form of a concentrate containing 15 to 60 parts by weight of said nitrocellulose and 20 to 70 parts by weight of polyether.

5. An ignition improver according to claim 1 wherein said polyether is the reaction product of ethylene oxide and a compound of the formula $$R^1—OH$$

in which $R^1$ denotes hydrogen or alkyl, which is optionally substituted by hydroxyl or amino.

6. An ignition improver according to claim 6 wherein $R^1$ represents alkyl of 1 to 6 carbon atoms.

7. An ignition improver according to claim 1 wherein said polyether is the reaction product of ethylene oxide and a compound of the formula

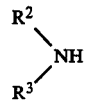

in which $R^2$ and $R^3$ are identical or different and denote hydrogen or alkyl, which is optionally substituted by hydroxyl or amino.

8. An ignition improver according to claim 7 wherein at least one of $R^2$ and $R^3$ is an alkyl group and said alkyl group has one to six carbon atoms.

9. An ignition improver according to claim 1 wherein said polyether contains 0.1 to 0.5 propylene oxide units per ethylene oxide unit.

10. A fuel mixture for an internal combustion engine comprising an alcohol having from 1 to 6 carbon atoms and an ignition improver, said ignition improver comprising nitrocellulose with a nitrogen content of 9 to 14% by weight and an intrinsic viscosity of less than 1000 and a polyether with at least three ethylene oxide units; the ratio of nitrocellulose to polyether being from 1:0.2 to 1:20; said fuel mixture containing 3 to 20 parts by weight of ignition improver based upon the weight of alcohol and wherein the concentration of the nitrocellulose in the propellant mixture is 2 to 12% by weight.

11. A fuel mixture according to claim 10 wherein said nitrocellulose has an intrinsic viscosity in the range from 200 to 800.

12. A fuel mixture according to claim 10 wherein said polyether has 4 to 100 ethylene oxide units.

13. A fuel mixture according to claim 10 wherein the ratio of nitrocellulose to polyether is 1:0.2 to 20.

14. A fuel mixture according to claim 10 wherein the ratio of nitrocellulose to polyether is 1:0.5 to 1.5.

15. A fuel mixture according to claim 10 wherein said polyether is the reaction product of ethylene oxide and a compound of the formula $$R^1—OH$$

in which $R^1$ denotes hydrogen or alkyl, which is optionally substituted by hydroxyl or amino.

16. A fuel mixture according to claim 10 wherein said polyether is the reaction product of ethylene oxide and a compound of the formula

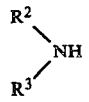

in which $R^2$ and $R^3$ are identical or different and denote hydrogen or alkyl, which is optionally substituted by hydroxyl or amino.

17. A fuel mixture according to claim 10 wherein said alcohol is methanol.

18. An ignition improver according to claim 1 wherein said internal combustion engine is a diesel engine.

19. A fuel mixture according to claim 11, wherein said internal combustion engine is a diesel engine.

* * * * *

UNITED STATES PATENT AND TRADEMARK OFFICE

CERTIFICATE OF CORRECTION

PATENT NO. : 4,659,335

DATED : April 21, 1987

INVENTOR(S) : Christian Wegner, et al.

It is certified that error appears in the above-identified patent and that said Letters Patent is hereby corrected as shown below:

| | |
|---|---|
| Col. 6, line 12 | Delete "Equals" and substitute --Equal-- |
| Col. 8, line 20 | Delete "claim 11" and substitute --claim 10-- |

Signed and Sealed this

Eighteenth Day of August, 1987

*Attest:*

DONALD J. QUIGG

*Attesting Officer*

*Commissioner of Patents and Trademarks*